US009212429B2

(12) United States Patent
Yomogida et al.

(10) Patent No.: US 9,212,429 B2
(45) Date of Patent: Dec. 15, 2015

(54) GOLD PLATING SOLUTION

(75) Inventors: Koichi Yomogida, Niigata (JP); Makoto Kondo, Konosu (JP)

(73) Assignee: Rohm and Haas Electronic Materials LLC

( * ) Notice: Subject to any disclaimer, the term of this patent is extended or adjusted under 35 U.S.C. 154(b) by 809 days.

(21) Appl. No.: 13/301,942

(22) Filed: Nov. 22, 2011

(65) Prior Publication Data

US 2012/0132533 A1 May 31, 2012

(30) Foreign Application Priority Data

Nov. 25, 2010 (JP) ..... 2010-262974

(51) Int. Cl.

| | |
|---|---|
| ***C25D 3/56*** | (2006.01) |
| ***C25D 7/00*** | (2006.01) |
| ***C23C 28/02*** | (2006.01) |
| ***C25D 3/62*** | (2006.01) |

(52) U.S. Cl.
CPC ..... *C25D 3/62* (2013.01)

(58) Field of Classification Search
CPC ..... C25D 3/48; C25D 3/62; C25D 3/56; C25D 3/562; C25D 7/00; C23C 28/02; C23C 28/021
USPC ..... 205/247, 266, 267, 268, 259, 184
See application file for complete search history.

(56) References Cited

U.S. PATENT DOCUMENTS

| | | | | |
|---|---|---|---|---|
| 3,642,589 | A | 2/1972 | Nobel et al. | |
| 4,038,161 | A | 7/1977 | Eckles et al. | |
| 4,076,598 | A * | 2/1978 | Lerner et al. | 205/250 |
| 6,287,371 | B1 * | 9/2001 | Ota | C23C 18/42 106/1.18 |
| 6,610,192 | B1 | 8/2003 | Step et al. | |
| 2004/0195107 | A1 * | 10/2004 | Chalumeau et al. | 205/247 |
| 2004/0249177 | A1 * | 12/2004 | Wang et al. | 549/563 |
| 2007/0084732 | A1 * | 4/2007 | Wang et al. | 205/296 |

OTHER PUBLICATIONS

Raub et al., "Incorporation of Carbon-Containing Impurities in the Electrodeposition of Gold and Gold Alloy Coatings in Acid and Alkaline Cyanide Baths," Werkstoffe and Korrosion (no month, 1972), vol. 23, No. 8, pp. 643-647. Abstract Only.*

* cited by examiner

*Primary Examiner* — Edna Wong
(74) *Attorney, Agent, or Firm* — John J. Piskorski

(57) ABSTRACT

A gold plating bath and a plating method is disclosed where gold cyanide or salts thereof provide the source of gold, a cobalt compound, and a reaction product of compound containing at least a nitrogen-containing heterocyclic compound and an epihalohydrin. The gold plating bath has high deposition selectivity.

6 Claims, No Drawings

GOLD PLATING SOLUTION

FIELD OF THE INVENTION

The present invention relates to a gold plating solution. More specifically, the present invention relates to an electrolytic gold plating solution.

BACKGROUND OF THE INVENTION

Recently, gold plating has been used for electronic equipment and electronic components because of gold's excellent electrical characteristics, and corrosion resistance, and especially, it has been widely used to protect the surface of the contact ends of the electronic parts. Gold plating has been used as the surface treatment for electrode terminals of semiconductor elements, or as a surface treatment for electronic components such as the connectors that connect the electronic equipment as well. Materials that use gold plating include, for example, metals, ceramics and semiconductors. The connectors used to connect electronic equipment use hard gold plating because of their utilization properties and require good corrosion resistance, wear resistance and electrical conductivity. Hard gold plating using gold/cobalt alloy plating and gold/nickel alloy plating have been known for a long time. Examples of such hard gold plating are disclosed in U.S. Pat. No. 2,905,601 and U.S. Pat. No. 4,591,415.

In general, electronic components such as connectors made from copper or a copper alloy. When gold is plated on copper or copper alloy, typically, nickel is plated on the copper or copper alloy surface as a barrier layer. The gold is then plated on the surface of the nickel plated layer. In general partial hard gold plating such as spot plating, plating with restricted surface and brush plating on electronic parts such as connectors is common. In the manufacturing process of these electronic components, plating is conducted by masking on the areas of electronic components where plating is not desired in order to restrict the amount of gold that is used since gold is very costly. However, when using conventional gold plating solutions, there is a problem that gold is deposited on the areas where gold is not needed. The solution of gold spreads along the surface of the object which is being plated, the gold solution spreads into the space between the mask and the object which is being plated, or the gold plates on the mask covering the portions of the object where plating is undesired.

In order to solve this problem, hexamethylene tetramine has been added to a hard gold plating solution such as disclosed in JP2008045194 patent publication published Feb. 28, 2008. However, this plating solution may be unstable. Accordingly, there is a need for an improved gold electroplating solution.

SUMMARY OF THE INVENTION

The objective of this invention is to provide a gold plating solution and a gold plating method that can satisfy the properties of gold plating films that is used for the surface of electronic components, especially connectors, and also which can deposit the gold plated film in the desired areas but which can restrict depositing it in undesired areas, and is stable during storage.

In order to solve the above mentioned problem and as a result of diligent investigation into gold plating solutions, the present inventors discovered that adding a reaction product of a compound containing at least a nitrogen-containing heterocyclic compound and an epihalohydrin into the gold plating solution, the long term stability of the gold plating solution can be improved compared with prior gold solutions, the gold film with the corrosion resistance, wear resistance and conductivity that are desired for electronic parts can be obtained, and gold deposition can be restricted to areas where gold is desired.

By using the gold plating solution of this invention, it is possible to deposit the gold plated film on the desired areas while restricting deposition on undesired areas. Specifically, the gold plating solution of the present invention is selective in gold deposition. Since the plated film is not deposited on the areas where the plating is not desired, the process of removing the plated film that was deposited on undesired places can be omitted, and also, the unnecessary consumption of metal can be restricted, therefore, the gold solution is useful from an economic view point as well. Further, the gold plating solution of this invention can be used over a broad current density range. Also a good gold plated film can be obtained even at mid to high electric current densities. Therefore, compared with conventional gold plating solutions, the plating speed is faster and the work efficiency is also good. The gold plating solution of this invention can form the hard gold plated film that has the corrosion resistance, wear resistance and electrical conductivity that are required for the electronic components such as connectors. Further, the gold plating solution of this invention has good stability such that it is useful for industrial applications.

DETAILED DESCRIPTION OF THE INVENTION

The gold plating solutions of this invention include gold cyanide or salt thereof, a cobalt compound, and a reaction product of a compound containing at least a nitrogen-containing heterocyclic compound and an epihalohydrin.

As the gold cyanide or its salt, which is an essential component in this invention, includes, but is not limited to, potassium dicyanoaurate; potassium tetracyanoaurate; ammonium cyanoaurate; potassium dichloroaurate; sodium dichloroaurate; potassium tetrachloroaurate; sodium tetrachloroaurate; gold potassium thiosulfate; gold sodium thiosulfate; gold potassium sulfite; gold sodium sulfite, and combinations of two or more thereof can be used. The preferred ones for the plating solution of this invention are gold cyanide salts, especially potassium dicyanoaurate.

The amount of the gold salt to be added in the plating solution can be, as gold, generally, in the range of 1 g/L to 20 g/L, and preferably it can be 4 g/L to 12 g/L.

Any cobalt compound can be used in this invention as long as it is soluble in water. For example, cobalt sulfate, cobalt chloride, cobalt carbonate, cobalt sulfaminate, cobalt gluconate, and combinations of two or more thereof can be used. The preferred ones for the plating solution of this invention are inorganic cobalt salts, especially basic cobalt carbonate. The amount of the cobalt compound to be added in the plating solution should be generally in the range of 0.05 g/L, to 3 g/L, preferably it should be 0.1 g/L to 1 g/L.

In this invention, the liquid can comprise other water soluble metal compounds other than gold and cobalt. The other metals which can be used for the solution, includes, but are not limited to, silver, nickel and copper.

The gold solution also includes a reaction product of a compound containing at least a nitrogen-containing heterocyclic compound and an epihalohydrin. In addition, a reaction product of a nitrogen-containing heterocyclic compound, an epihalohydrin and a third component may be included in the gold solution. The reaction product may be one that is obtained by heating the solution including a nitrogen-containing heterocyclic compound, an epihalohydrin and a third component. Examples of nitrogen-containing heterocyclic compounds include, but are not limited to, imidazole and pyridine. Combinations of two or more of nitrogen-containing heterocyclic compounds may be used. The halogen in the epihalohydrin can be fluorine, chlorine, bromine or iodine, and combinations of 2 or more epihalohydrins may be used. Specific examples of epihalohydrins which can be used, include, but are not limited to, epichlorohydrin and epibromohydrin. One example of the method for preparing the reaction product is dissolving imidazole and epichlorohydrin in the same solvent at the desired concentrations, and, for example, heating for 20-240 minutes. Another example is heating a solution which includes a nitrogen-containing heterocyclic compound at 40-95° C., and the epihalohydrin is added in the solution slowly. At this time, as is described in the U.S. Pat. No. 7,128,822, the reaction can be conducted by adding an alkylene oxide in addition to imidazole and the epihalohydrin. Alkylene oxides include, but are not limited to, ethylene glycol; di-ethylene glycol; tri ethylene glycol; poly ethylene glycol; propylene glycol; di-propylene glycol; di-propylene glycol; poly propylene glycol; butylene glycol; poly butylene glycol; copolymer of ethylene oxide and propylene oxide; copolymer of ethylene oxide and butylene oxide. One, two or more alkylene oxides may be used. Any ratio of these components in the reacting product can be used. One example for forming the reaction product is mixing the desired amount of imidazole and di-ethylene glycol, then adding de-ionized water and heating at 85-90° C. and adding epicholrohydrin at 90-98° C. for 8 hours followed by cooling to room temperature by leaving at room temperature overnight.

The amount of the reacting product of compound containing at least a nitrogen-containing heterocyclic compound and an epihalohydrin to be added in the plating liquid should be generally in the range of 0.001-1 g/L and preferably it should be 0.03-0.5 g/L.

In this invention, depending on necessity, additives may be included in the gold solutions. Such additives include, but are not limited to chelating agents, pH adjusting agents and conductive salts.

The chelating agents which can be used in this invention may be any commonly known chelating compound. Carboxyl group-containing compounds include, but are not limited to, citric acid; potassium citrate; sodium citrate; tartaric acid; oxalic acid; and succinic acid, and the phosphonic acid group-containing compounds containing a phosphonic acid group or salt thereof in the molecule can be used. Examples of phosphonic acid group-containing compounds include aminotri methylene phosphonic acid; 1-hydroxyethylidene-1,1-diphosphonic acid; ethylenediamine tetramethylene phosphonic acid; diethylenetriamine pentamethylene phosphonic acid and other compounds having a plurality of phosphoric acid groups within the molecule as well as alkali metal salts or ammonium salts thereof. Furthermore, nitrogen compounds such as ammonia, ethylenediamine or triethanolamine can be used as an auxiliary chelating agent together with a carboxyl group-containing compound. The chelating agents can also be used in combinations of two or more types. Some of the above mentioned chelating agents may be compounds which act as the post-mentioned conducting salt. The use of compounds that act as a chelating agent and also act as a conductive salt is preferable.

The amount of chelating agent to be added into the plating liquid should be generally in the range of 0.1 g/L to 300 g/L, preferably in the range of 1 g/L to 200 g/L.

The conductive salt that can be used in this invention may be either organic compounds or inorganic compounds. Examples of those organic compounds include compounds that act as a chelating agent, and include, but are not limited to, carboxylic acids and salts thereof such as citric acid; tartaric acid, adipic acid, malic acid, succinic acid, lactic acid and benzoic acid and compounds having phosphonic acid groups and salts thereof. Examples of such inorganic compounds include alkali metal salts or ammonium salts of phosphoric acid, sulfurous acid, nitrous acid, nitric acid, sulfuric acid. Furthermore, the combinations of two or more conductive salts can be used. Preferably the salt forms such as ammonium dihydrogen phosphate, diammonium phosphate are added.

The amount of conductive salt to be added in the plating solution should be generally in the range of 0.1 g/L-300 g/L, preferably the range of 1 g/L-100 g/L.

The pH of the gold cobalt alloy plating solution of this invention should be adjusted to the acidic region. The preferred pH range is 3 to 6. The pH can be adjusted by adding an alkali metal hydroxide, for instance potassium hydroxide or other alkali hydroxides, or acidic substances such as citric acid or phosphoric acid. Especially, adding a compound that provides a pH buffering effect to the gold plating solution is preferable. Citric acid, tartaric acid, oxalic acid, succinic acid, phosphoric acid, sulfurous acid and salts thereof can be used as the compound that provides pH buffering effect. By adding these compounds that have a pH buffering effect, the pH of the plating solution can be maintained uniform, and the plating operation can be performed for a long period of time.

The gold plating solution of this invention can be prepared and be used by adding the above mentioned compounds according to already known methods. For example, the plating solution of the invention can be obtained by adding the above mentioned amount of gold cyanide or salt thereof, soluble cobalt compound, and the reaction product of compound including at least a nitrogen-containing heterocyclic compound and epichlorohydrin into water at the same time or separately, and stirring, adding a conductive salt component, a chelating agent, a pH adjusting agent, a pH buffering agent to adjust the pH if necessary.

When performing the gold plating of this invention, the plating solution temperature should be in the range of 20 to 80° C., preferably in the range of 40 to 60° C. The current density should be 1 to 60 A/dm$^2$. The plating solution of this invention can be used at a high current density of 10 to 60 A/dm$^2$. As the anode, either a soluble anode or an insoluble anode can be used, but the use of insoluble anode is preferable. During conducting the electrolytic plating, stirring the plating liquid is preferable.

Conventional methods may be used for producing the electronic components using the gold plating solution. Such methods include, but are not limited to, spot plating, plating with restricted liquid surface and brush plating. All may be used to perform localized gold plating of electronic components such as connectors.

When gold plating is conducted as a final surface finish of the connector, an intermediate metal layer, such as a nickel film layer, may be plated. When a surface of a connector is plated, typically nickel is plated as the intermediate layer. A gold film can be plated using the present invention by spot electrolytic plating on a conductive layer such as nickel metal.

The following examples are intended to illustrate the invention, but are not intended to limit the scope of the invention.

EXAMPLES 1-2, AND COMPARISONS 1-3

As is shown below, the gold cobalt alloy plating solution containing of the substances shown in Table 1 was prepared, and the Hull cell test was conducted.

Potassium dicyanoaurate: 6 g/L (4 g/L as the gold)

Basic cobalt carbonate solution: 10 mL/L (250 mL/L as cobalt)

Tripotassium citrate monohydrate: 50 g/L

Citric acid anhydride: 32 g/L

Compounds shown in Table 1: Amount indicated in Table 1

Water (de-ionized water): Balance

Hull Cell Test

A Hull cell test was performed using an insoluble anode of titanium covered by platinum and copper Hull cell panel as a cathode was nickel plated at a bath temperature of 50° C. with stirring at the speed of 2 m/min by an anode rocker. Current between the cathode and the anode was 1 A (ampere) for 3 minutes. The results of the Hull cell test and the appearance of the Hull cell panel are shown in Table 2 and Table 3. Here, the Hull cell test result means that the thickness of the plated layer observed a total of 9 points beginning from the point of 2 cm from the bottom and 1 cm from left side (high current density side) of the Hull cell panel, and continuing to a point to the right edge at 1 cm intervals (low current density side).

The appearance of the Hull cell panel is indicated by the length of the area each 'burn' 'dull' and 'bright' deposit beginning at the point from left side of the Hull cell panel towered the right side. Table 3 also shows the voltage during the Hull cell test.

TABLE 1

| | Type of additive | Amount added (g/L) |
|---|---|---|
| Example 1 | A reaction product 1 of compound containing at least a nitrogen-containing heterocyclic compound and an epihalohydrin | 0.1 |
| Example 2 | A reaction product 2 of compound containing at least a nitrogen-containing heterocyclic compound and an epihalohydrin | 0.1 |
| Comparison 1 | None | |
| Comparison 2 | Hexamethylenetetramine | 0.5 |
| Comparison 3 | Imidazole | 0.5 |

The reaction products 1 and 2 that were obtained by reaction of a compound containing at least a nitrogen-containing heterocyclic compound and an epihalohydrin were formed according to the method described in Examples 1 and 3 in the description of the U.S. Pat. No. 7,128,822.

TABLE 2

| Hull Cell Test Results | | | | | | | | | |
|---|---|---|---|---|---|---|---|---|---|
| | 1 | 2 | 3 | 4 | 5 | 6 | 7 | 8 | 9 |
| Example 1 | 0.72 | 0.7 | 0.71 | 0.63 | 0.67 | 0.55 | 0.45 | 0.23 | 0.19 |
| Example 2 | 0.75 | 0.73 | 0.67 | 0.64 | 0.69 | 0.57 | 0.38 | 0.24 | 0.15 |
| Comparison 1 | 0.8 | 0.8 | 0.7 | 0.79 | 0.88 | 0.8 | 0.63 | 0.4 | 0.24 |
| Comparison 2 | 0.89 | 0.79 | 0.76 | 0.75 | 0.68 | 0.51 | 0.4 | 0.24 | 0.14 |

TABLE 2-continued

| Hull Cell Test Results | | | | | | | | | |
|---|---|---|---|---|---|---|---|---|---|
| | 1 | 2 | 3 | 4 | 5 | 6 | 7 | 8 | 9 |
| Comparison 3 | 0.72 | 0.73 | 0.72 | 0.73 | 0.77 | 0.78 | 0.69 | 0.45 | 0.28 |

TABLE 3

| Hull Cell Test Appearance | | | | |
|---|---|---|---|---|
| | Burn deposit | Dull deposit | Bright | Voltage |
| Example 1 | 0.2 | 4.8 | 5 | 7.4 V |
| Example 2 | 0.2 | 1.8 | 8 | 7.1 V |
| Comparison 1 | 1.5 | 4.5 | 4 | 7.1 V |
| Comparison 2 | 1.5 | 3 | 5.5 | 6.1 V |
| Comparison 3 | 1.5 | 4 | 4.5 | 7.3 V |

EXAMPLES 3-11, AND COMPARISON 3

Spot tests were conducted using the plating solution prepared by using the additives used in the above mentioned Examples.

Spot Test

A copper plate on which nickel plating was deposited as an undercoat film was prepared as the material to be plated. In order to verify the selective deposition of the gold plated film, a mask of silicon rubber was formed on the whole surface of this copper plate and then a part of the mask, diameter of 10 mm, was removed. However, a gap between the nickel plated layer and the mask layer of the mask section, width 1.5 mm, along the edge of the section without the mask was formed by pressing a 0.5 mm thick epoxy resin plate between the mask layer and the nickel plated layer around the edge of the exposed section without the mask. Therefore, when the plating liquid was sprayed onto the material to be plated, it was possible for the plating liquid to penetrate into the space between the mask layer and the nickel plated layer. The current density was low during the electroplating at the space because the mask layer present above the space compared with the open area without the mask.

The gold cobalt alloy plating was conducted on the material to be plated, while spraying the prepared plating solution with a pump with the current densities indicated in Tables 4 and 5, using an insoluble cathode of platinum coated titanium, at a bath temperature of 50° C. The plating time was 10 seconds each. The thickness of the deposited films at this time is shown in Table 4, and the thickness of the film deposited in the space between the mask layer and the nickel plated layer is shown in Table 5. Table 4 shows the deposited film thickness of gold plate on the desired area, and Table 5 shows the deposited film thickness of gold plate on the un-desired area. The units are micro meters (μm).

TABLE 4

| | Additive | Concentration | 1ASD | 3ASD | 5ASD | 10ASD | 20ASD | 30ASD | 40ASD | 50ASD |
|---|---|---|---|---|---|---|---|---|---|---|
| Comparison 3 | None | | 0.014 | 0.070 | 0.127 | 0.264 | 0.698 | 1.102 | 1.347 | |
| Example 3 | A reaction product 1 of a | 0.1 g/L | 0.017 | 0.051 | 0.075 | 0.145 | 0.353 | 0.573 | 0.787 | 0.825 |
| Example 4 | compound containing at | 0.2 g/L | 0.015 | 0.044 | 0.054 | 0.074 | 0.077 | 0.124 | 0.437 | 0.666 |
| Example 5 | least a nitrogen-containing | 0.5 g/L | 0.016 | | | 0.040 | | | | |
| Example 6 | heterocyclic compound and an epihalohydrin | 1.0 g/L | | | | 0.045 | | | | |
| Example 7 | A reaction product 2 of a | 0.05 g/L | 0.008 | 0.020 | 0.044 | 0.273 | 0.615 | 0.882 | 1.001 | 1.021 |
| Example 8 | compound containing at | 0.075 g/L | 0.007 | 0.017 | 0.022 | 0.113 | 0.535 | 0.810 | 0.940 | 0.914 |
| Example 9 | least a nitrogen-containing | 0.10 g/L | 0.005 | 0.017 | 0.025 | 0.029 | 0.266 | 0.786 | 0.922 | 0.959 |
| Example 10 | heterocyclic compound and | 0.125 g/L | 0.005 | 0.016 | | 0.032 | | 0.638 | | 0.970 |
| Example 11 | an epihalohydrin | 0.15 g/L | 0.007 | 0.012 | 0.023 | 0.027 | 0.048 | 0.098 | 0.554 | 0.856 |

TABLE 5

| | Additive | Concentration | 1ASD | 3ASD | 5ASD | 10ASD | 20ASD | 30ASD | 40ASD | 50ASD |
|---|---|---|---|---|---|---|---|---|---|---|
| Comparison 3 | None | | 0.006 | 0.018 | 0.036 | 0.044 | 0.103 | 0.089 | 0.139 | |
| Example 3 | A reaction product 1 of a | 0.1 g/L | 0.010 | 0.026 | 0.021 | 0.044 | 0.046 | 0.097 | 0.070 | 0.136 |
| Example 4 | compound containing at | 0.2 g/L | 0.007 | 0.020 | 0.017 | 0.035 | 0.011 | 0.036 | 0.052 | 0.059 |
| Example 5 | least a nitrogen-containing | 0.5 g/L | 0.008 | x | x | 0.018 | x | x | x | x |
| Example 6 | heterocyclic compound and an epihalohydrin | 1.0 g/L | x | x | x | 0.012 | x | x | x | x |
| Example 7 | A reaction product 2 of a | 0.05 g/L | 0.008 | 0.013 | 0.016 | 0.005 | 0.026 | 0.017 | 0.144 | 0.150 |
| Example 8 | compound containing at | 0.075 g/L | 0.001 | 0.007 | 0.006 | 0.010 | 0.006 | 0.038 | 0.050 | 0.043 |
| Example 9 | least a nitrogen-containing | 0.10 g/L | 0.003 | 0.008 | 0.004 | 0.005 | 0.025 | 0.021 | 0.027 | 0.022 |
| Example 10 | heterocyclic compound and | 0.125 g/L | 0.004 | 0.008 | | 0.020 | | 0.018 | | 0.028 |
| Example 11 | an epihalohydrin | 0.15 g/L | 0.004 | 0.006 | 0.0125 | 0.003 | 0.0145 | 0.033 | 0.0305 | 0.022 |

EXAMPLE 12

A bath stability test was conducted using a plating solution which includes an additive used in Example 2, and a conventional bath (product name: RONOVEL™ CS-100 bath additive, available from Rohm and Haas Electronic Materials, LLC). 100 mL of each plating solution was prepared and injected into a 100 mL container. The above mentioned container was heated in a water bath at 50° C., and kept for 19 hours at room temperature. This cycle was repeated. The turbidity was measured with a turbidity meter after 0-5 days. The results are shown in Table 6. The units are NTU.

TABLE 6

| | | Just after made (0 days) | 1 day later | 2 days later | 3 days later | 4 days later | 5 days later |
|---|---|---|---|---|---|---|---|
| Example 12 | Product of this invention | 0 | 6.3 | 6.8 | 27 | 36.7 | 38.8 |
| Comparison | Conventional bath | 0 | 89 | 121 | 147 | 193 | 299 |

As shown in the above mentioned Examples and Comparisons, a gold plating film was obtained by using the plating solution of the present invention, which deposited on the desired areas with limited deposition on the undesired areas, and the selective deposition was improved. In addition, the gold plating solution of this invention has improved bath stability at high temperature compared with the conventional bath, such that it may be used industrially.

What is claimed is:

1. A gold cobalt alloy plating solution consisting of a gold cyanide or salt thereof, a cobalt compound, a conductive salt, water, a reaction product of a compound containing a nitrogen-containing heterocyclic compound, an epihalohydrin and an alkylene oxide, and optionally additives chosen from a chelating agent, and a pH adjusting agent.

2. The gold cobalt alloy plating solution of claim 1, wherein the nitrogen-containing heterocyclic compound is chosen from imidazole, pyridine and mixtures thereof.

3. The gold cobalt alloy plating solution of claim 1, wherein the epihalohydrin is chosen from epichlorohydrin, epibromohydrin and mixtures thereof.

4. A method of electroplating a gold cobalt alloy comprising:

a) providing an electronic component;

b) providing a gold cobalt alloy plating solution consisting of a gold cyanide or salt thereof, a cobalt compound, a conductive salt, water, a reaction product of a compound containing a nitrogen-containing heterocyclic compound, an epihalohydrin and an alkylene oxide, and optionally additives chosen from a chelating agent, and a pH adjusting agent.

c) immersing the electronic component in the gold cobalt alloy plating solution; and d) electroplating gold cobalt alloy on the electronic component.

5. The method of electroplating gold cobalt alloy of claim 4, wherein the electronic component is a connector.

6. The method of claim 5, wherein the gold cobalt alloy is electroplated on a nickel film layer of the connector.

* * * * *